US006981763B2

(12) United States Patent
Studer et al.

(10) Patent No.: US 6,981,763 B2
(45) Date of Patent: Jan. 3, 2006

(54) BACK-PRESSURE GENERATING FLUID CONTAINMENT STRUCTURE AND METHOD

(75) Inventors: Anthony D. Studer, Albany, OR (US); Kevin D. Almen, Albany, OR (US); David M. Hagen, Corvallis, OR (US); David J. Benson, Albany, OR (US); Cary R. Bybee, Lebanon, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 252 days.

(21) Appl. No.: 10/732,073

(22) Filed: Dec. 10, 2003

(65) Prior Publication Data

US 2005/0128262 A1 Jun. 16, 2005

(51) Int. Cl.
*B41J 2/175* (2006.01)

(52) U.S. Cl. ..... 347/86; 347/85

(58) Field of Classification Search ..... 347/84, 347/85, 86, 87

See application file for complete search history.

(56) References Cited

U.S. PATENT DOCUMENTS

| | | | | |
|---|---|---|---|---|
| 5,368,802 | A | 11/1994 | Wanha | |
| 5,409,134 | A * | 4/1995 | Cowger et al. | 222/1 |
| 5,541,632 | A | 7/1996 | Khodapanah et al. | |
| 5,719,609 | A * | 2/1998 | Hauck et al. | 347/85 |
| 5,871,784 | A | 2/1999 | Assink et al. | |
| 5,975,686 | A | 11/1999 | Hauck et al. | |
| 6,428,153 | B1 * | 8/2002 | Hsu et al. | 347/85 |

* cited by examiner

*Primary Examiner*—Anh T. N. Vo

(57) ABSTRACT

A fluid containment structure includes a containment vessel having an interior vessel space for fluid containment, and a fluid outlet communicating with the interior vessel space. A flexible bag with opposed side surfaces is disposed within the containment vessel, vented to an external atmosphere outside the containment vessel. A sacrificial bond structure is formed between the side surfaces, and restrains the side surfaces together until a back-pressure within the vessel space exerts sufficient force to break the sacrificial bond structure, allowing air from the external atmosphere to enter the bag and enlarge an interior bag space.

59 Claims, 12 Drawing Sheets

FIG. 3
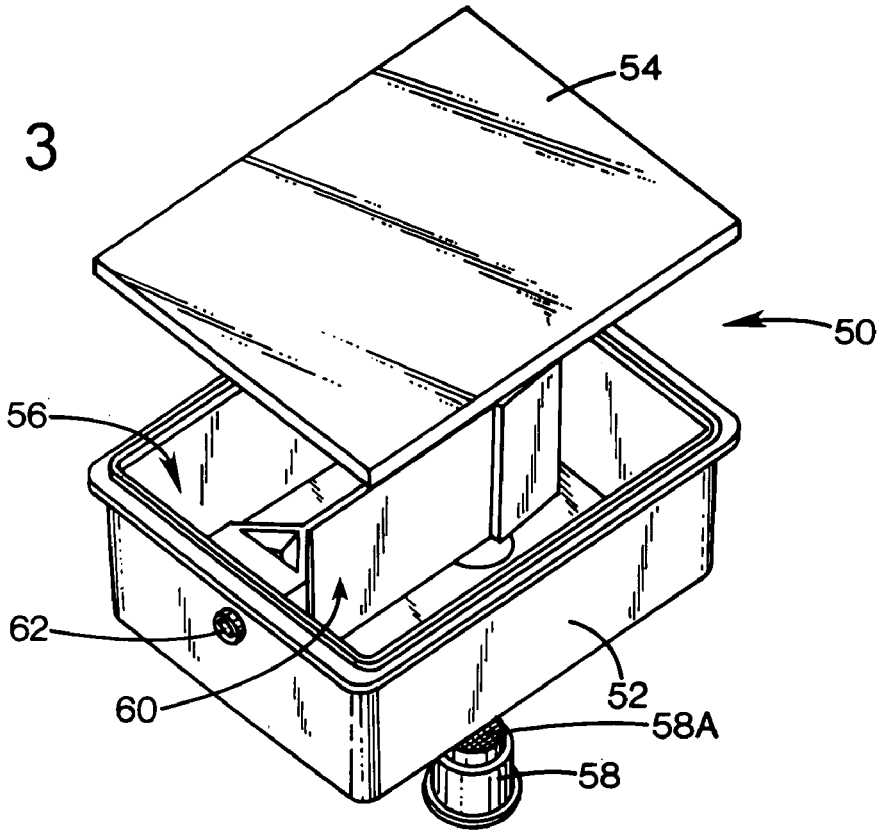
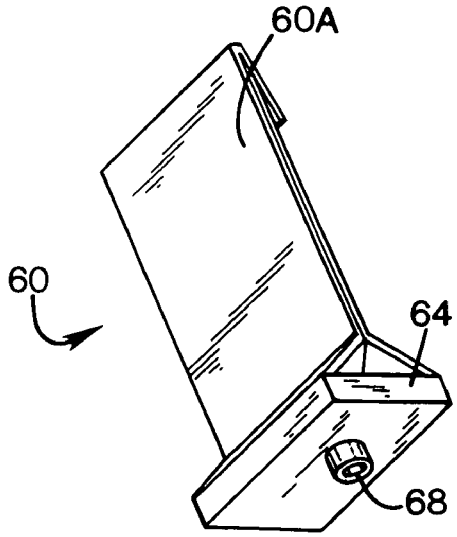
FIG. 4A
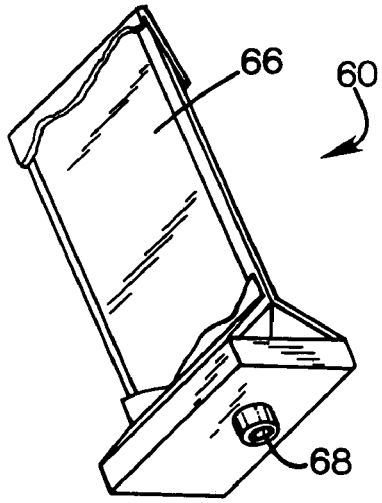
FIG. 4B

FIG. 15
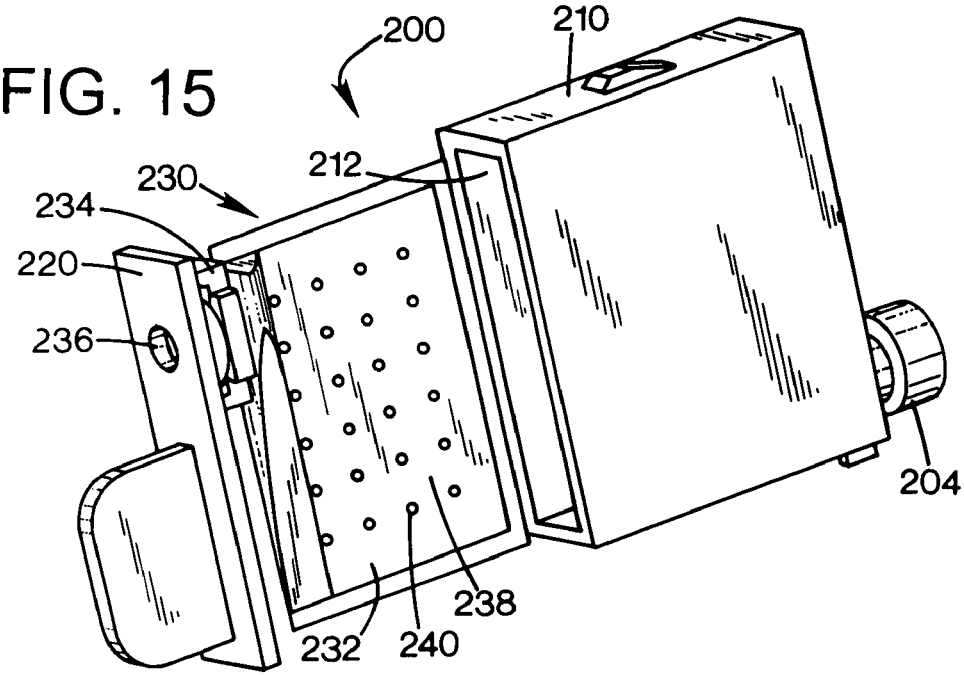
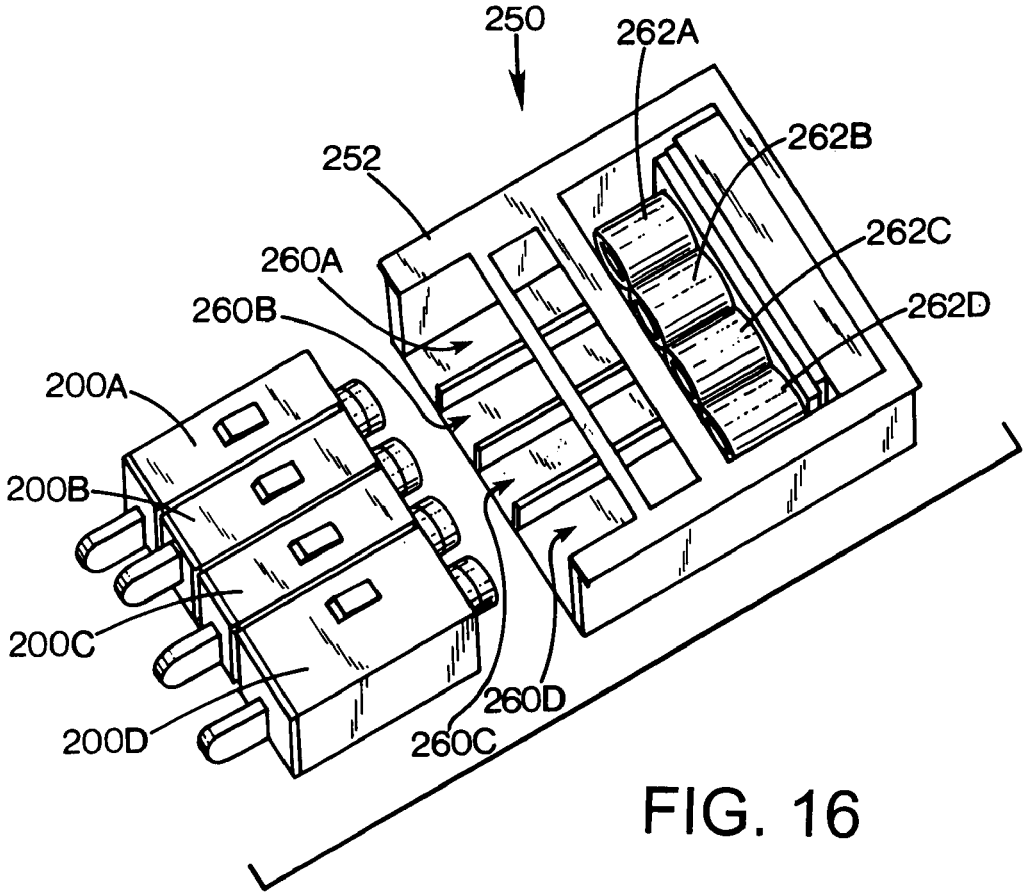
FIG. 16

BACK-PRESSURE GENERATING FLUID CONTAINMENT STRUCTURE AND METHOD

BACKGROUND

Fluid containment structures which generate back-pressure are used in applications such as ink-jet fluid supplies and print cartridges. A back-pressure, i.e. a negative fluid pressure at a fluid outlet, is employed to provide proper system pressures and prevent fluid from drooling from fluid outlets or fluid nozzles. There is a need for back-pressure generating mechanisms that are reliable and are cost-effective to produce.

BRIEF DESCRIPTION OF THE DRAWINGS

Features and advantages of the disclosure will readily be appreciated by persons skilled in the art from the following detailed description when read in conjunction with the drawing wherein:

FIG. 3 is an exploded isometric view of an alternate embodiment of a fluid supply with a bag employing an internal adhesive to create negative pressure within the fluid reservoir.

FIG. 4A is an isometric view of the bag and fitment of the embodiment of FIG. 3.

FIG. 4B is an isometric view similar to FIG. 3, with a side of the bag cut away to show the internal adhesive layer.

FIG. 15 is a partially-exploded isometric view of an ink supply for a printhead, using a bag to create negative pressure.

FIG. 16 is a simplified isometric view of a plurality of ink supplies using bags to create negative pressure and a printhead structure to which the supplies are connectable.

DETAILED DESCRIPTION

Figure 1:
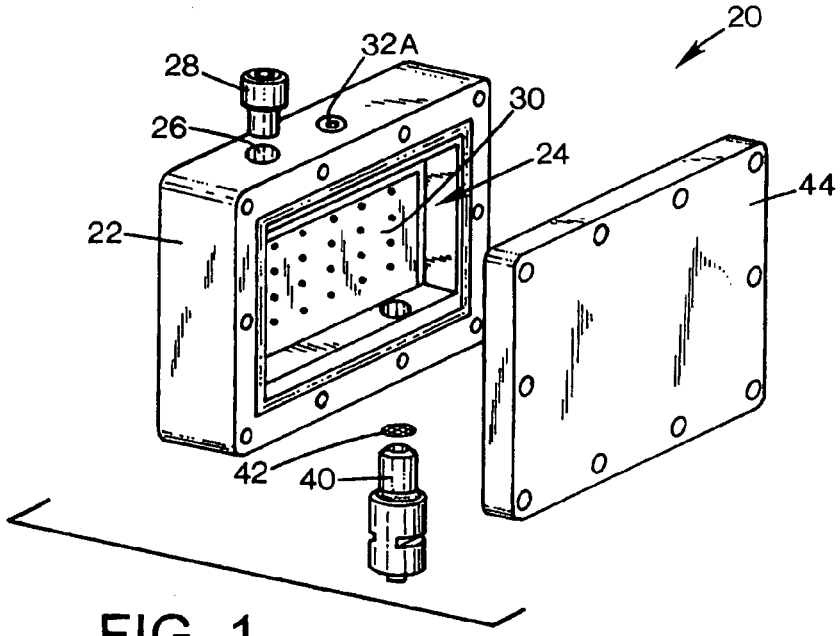
FIG. 1 is an exploded view of an exemplary embodiment of a fluid supply employing a staked bag for maintaining a negative fluid pressure within the fluid reservoir.

In the following detailed description and in the several figures of the drawing, like elements are identified with like reference numerals.

An exemplary embodiment of a fluid containment structure is for a backpressure-generating, free ink based replaceable fluid supply. In an exemplary application, the supply is used to store and supply ink for an ink-jet printing system. An exemplary embodiment of a fluid supply 20 is illustrated in FIGS. 1–2, and includes a containment vessel 22 defining an interior fluid chamber 24. A thin membrane bag 30 is positioned in the interior of the vessel, and is vented to the outside atmosphere through a vent hole 32A in a plastic fitment 32 which is sealed to the bag. The periphery of the fitment 32 is sealed to a hole in the vessel wall, so that only the exterior of the bag is exposed to the interior chamber 24 of the vessel. A fluid interconnect (FI) 40, e.g. an open foam/screen, or septum for a needle septum interface system, with a bubble screen 42, provides fluid communication between the outside of the housing and the fluid chamber 24. A cover 44 attaches to the vessel body 22 to seal the fluid chamber 24.

The bag 30 is shown in the isometric view of FIG. 2. In an exemplary embodiment, backpressure for the fluid supply is generated by the bag, which in an exemplary embodiment is constructed from a single, or multilayer non-elastic film with a form factor and volume that closely match the internal volume of the fluid chamber 24. To aid in material handling, assembly and pressure testing, the bag is constructed using the plastic fitment 32 with a through hole 32A, which provides air communication from the external atmosphere through the hole into the interior of the bag. Then the bag 30 is substantially evacuated and fixtured, so that two of the sides are flattened together and a sacrificial stake dot pattern 36 that has been tuned to the acceptable back pressure range for the system is applied to stake the two sides together. The stake pattern bonds only the adjacent internal sides of the bag together. In one exemplary application, the stake pattern 36 comprises a pattern of dots 38 having a typical diameter of 1.0 mm to 2.0 mm, arranged on center-to-center dot spacing ranging from 3 mm to 9 mm. The stake time is on the order of one second or less, at a temperature of 175 to 210° C. These parameters are for a bag fabricated from single-layer or multi-layer polyolefin type film with low WVTR (watervapor transmission rate). An exemplary film thickness is typically 2.5 mils (0.064 mm) or less. Depending on the supply and bag geometry, this operation may be repeated on more sides.

Figure 2B:
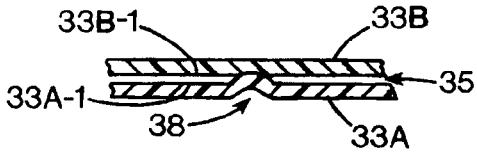
FIG. 2B is a partial cross-sectional view of the bag of FIG. 2, taken along line 2B—2B of FIG. 2.
Figure 2:
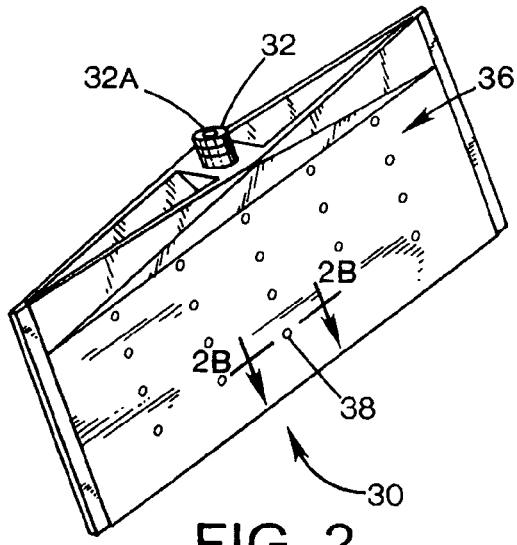
FIG. 2 is an isometric view of the bag of FIG. 1, showing a stake dot pattern.
Figure 2A:
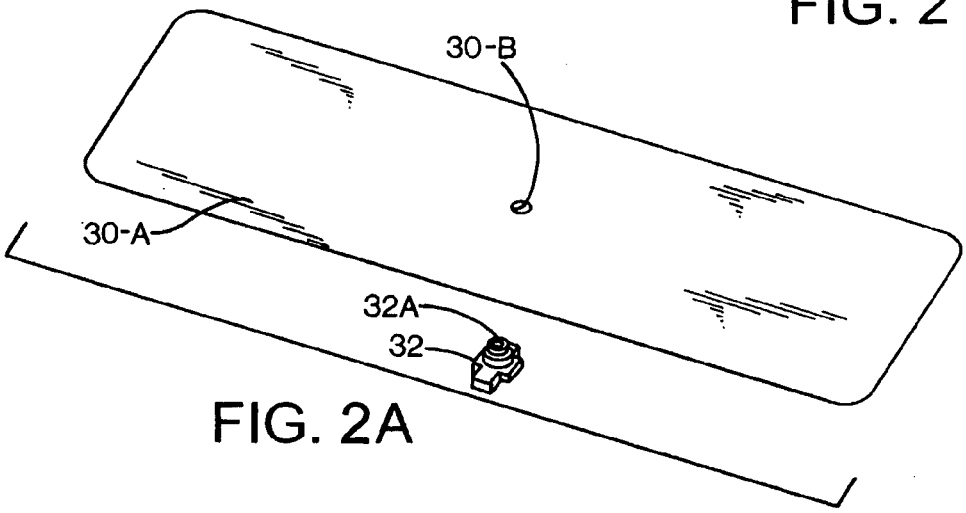
FIG. 2A is an exploded isometric view of an exemplary bag film and fitment.

FIG. 2A shows in exploded isometric view an exemplary bag film 30-A and fitment 32. The bag film has a hole 30-B punched through it, and is ready for fitment staking. In this example, the top of the fitment is to be staked to the inside-top surface of the bag film. Alternatively, the size of the hole 30-B can be reduced, and the bottom surface of the fitment staked to the outside-top surface of the bag film. The choice may depend on the film compatibility for staking to the fitment. Some films may be balanced, i.e. the same on both sides, or unbalanced, i.e. different because of layers added for WVTR/air barrier properties, for example.

FIG. 2B is a partial cross-sectional view of the bag 30, taken along line 2B—2B of FIG. 2, and showing bag films 33A, 33B comprising the bag 30, and an exemplary stake dot 38 formed between the inner surfaces 33A-1, 33B-1 of the bag films. The stake dot 38 is formed to provide a relatively weak bond between the inner surfaces, which will break after a force threshold has been exceeded.

The fitment 32 is sealed to an interior wall of the vessel body 22, or the cover 44, and the remaining assembly steps are completed, including attachment of the cover 44 to the vessel body 22, so the supply is ready for fluid fill. A fill port 26 is provided in the vessel body, through which fluid is released into the fluid chamber 24. In an exemplary embodiment, in order to maximize the fill volume, the bag is substantially evacuated again through the fitment during the ink fill process. When the supply is full, the fill port is sealed with a seal element 28. Initial back pressure is created by priming the supply through the FI. Since very little air is left inside the supply initially and the majority of the bag volume is restrained by the stake dot pattern, only a minor volume of fluid is extracted to create an initial backpressure in an exemplary 1–2.5 in. $H_2O$ range, i.e. between 248.8 Pascal (Pa) and 622.1 Pa.

There will inevitably be some open volume withinin the bag after it is assembled to the vessel body and substantially evacuated, for example between the layers of the bag, as illustrated as volume or space 35 (FIG. 2B), or adjacent the fitment. To improve robustness against damage caused by dropping the supply after filling the supply and before insertion into a printing system, which might tend to break one or more of the sacrificial bonds due to the shock, e.g. during shipping, the open volume within the bag can be filled with a liquid or gel having a density similar to the fluid which fills the reservoir. For example, if the fluid reservoir holds a supply of water-based ink, the fluid filled into the bag open volume can be water. This filling can be done by a syringe through the fitment. To prevent or reduce leakage or evaporation, a labyrinth vent can be used as the vent 32A.

Consider the case in which the fluid supply 20 is used as an ink supply for a printer, and the fluid is liquid ink. When the supply 20 is inserted into a printer and ink is consumed, the negative pressure inside the supply fluid chamber increases until the pressure on the bag 30 breaks one or more of the stake dots 38 restraining the bag. When this occurs, fractional volume from the bag is released, air enters this fractional volume through the vent 32A, and the pressure drops to a lower level. Thus, volume is exchanged between the extracted fluid and the expanding bag. The restraining force on the bag due to the stake dots creates the supply backpressure. As the sacrificial stake dot bonds break, the rising backpressure is reduced. This process repeats throughout the life of the supply to keep the backpressure within an acceptable range until the bag volume is maximized. At both the beginning and end of life the supply is robust during altitude, or temperature excursions because of the fixed minimal volume of air inside the supply.

For an exemplary backpressure range of interest of 1–12 in. $H_2O$, i.e. between 0.248.8 Pa and 2986.1 Pa, stakes 38 applied to the exterior of the bag only create a light bond between the inside surfaces of the bag. This is beneficial because when the stake dot bonds are broken the bag film integrity is maintained to prevent leakage.

In the embodiment of FIG. 1, backpressure in the fluid supply is generated by a sacrificial stake dot pattern applied to the outside of a bag structure comprising a bag formed from a film material and a plastic fitment. The plastic fitment serves only to seal the bag to an interior wall of the supply vessel, or the cover or lid of the supply, and to port the bag directly to atmosphere. In order to maximize supply efficiency, the fitment volume can be minimized. In other embodiments, the fitment can be eliminated altogether by attaching the bag directly to the containment vessel lid or vessel wall.

The embodiment of FIGS. 1–2B employs a negative pressure structure comprising a bag with a sacrificial stake dot pattern. Three additional sacrificial bond embodiments are shown in FIGS. 3–6, and respectively utilize a solid adhesive pattern applied to the inside walls of the bag, a solid stake pattern applied to the outside of the bag, and an adhesive dot pattern applied to the inside walls of the bag, respectively.

FIGS. 3 and 4A–4B illustrate an embodiment of a fluid supply 50 employing a negative pressure bag structure 60 including bag 60A. The supply includes a fluid vessel body 52 and a cover lid 54 which encloses an interior fluid chamber 56. An FI 58 with a filter screen 58A provides for fluid extraction from the fluid chamber. To provide negative pressure for the fluid supply, a bag structure 60 is disposed within the fluid chamber as in the embodiment of FIGS. 1–2. The bag 60A is vented to the outside environment through a vent hole 62 formed in the vessel body, and is otherwise sealed. A sacrificial bond structure provides a relatively weak bond between opposed sides of the bag, which in this embodiment is a solid adhesive layer 66 applied to the inside walls of the sides of the bag.

Referring now to FIG. 4A, the bag 60A is sealed to a plastic fitment 64 with a through hole, which in turn is attached to the wall of the vessel body. A tubing 68 is positioned in the through hole between an opening of the bag and the vent hole formed in the vessel body to provide an open passageway between the bag opening and the external atmosphere.

FIG. 4B is a simplified isometric view of the bag structure 60, with a facing bag side cutaway to show the solid adhesive layer 66 which forms a sacrificial bond structure between the bag sides. The filling and usage of the fluid supply are as described above regarding the embodiment of FIGS. 1–2. Exemplary adhesives suitable for the purpose include silicone, cross-linked silicon, and acrylic based adhesives, all of which have good creep resistant properties, i.e., the ability to hold under a constant force load (below the threshold at which the sacrificial bond is to break).

Figure 5:
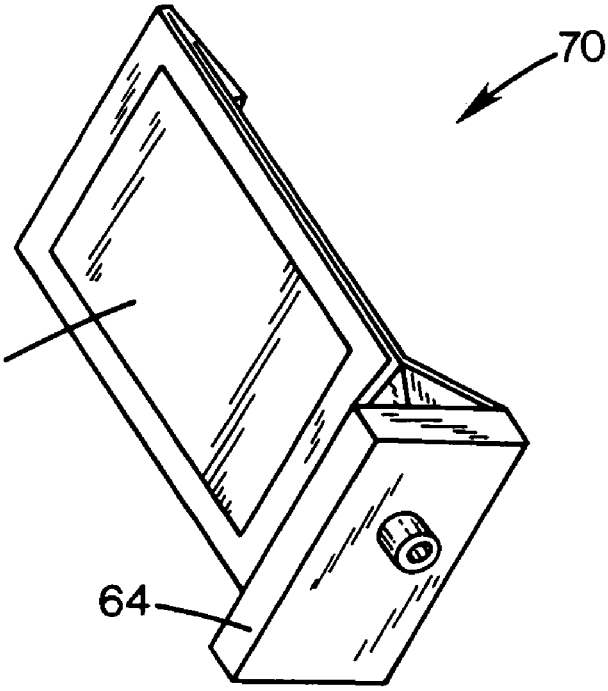
FIG. 5 is an isometric view of another embodiment of a bag suitable for use in a fluid supply or print cartridge, employing a solid stake pattern to create negative pressure.

FIG. 5 shows an alternate embodiment of a bag structure 70 which can be used as the negative pressure generating structure in the fluid supply 50 of FIG. 3. The bag structure includes a fitment 64 as with structure 60 (FIG. 4A). In this case, the sides of the bag have a solid sacrificial stake applied to the bag sides to form a sacrificial bond structure.

This embodiment is similar to that of FIGS. 3 and 4A–4B, except that the solid bond structure is formed by a heat stake bond instead of a layer of adhesive. In use, as fluid is drawn from the fluid chamber of the fluid supply, the bag sides will be drawn apart by the negative pressure, and the solid stake bond structure will incrementally break apart, allowing the bag sides to separate and relieve increasing negative pressure. in region 72. In other respects, the bag structure 70 is similar to bag structure 60.

Figure 6:
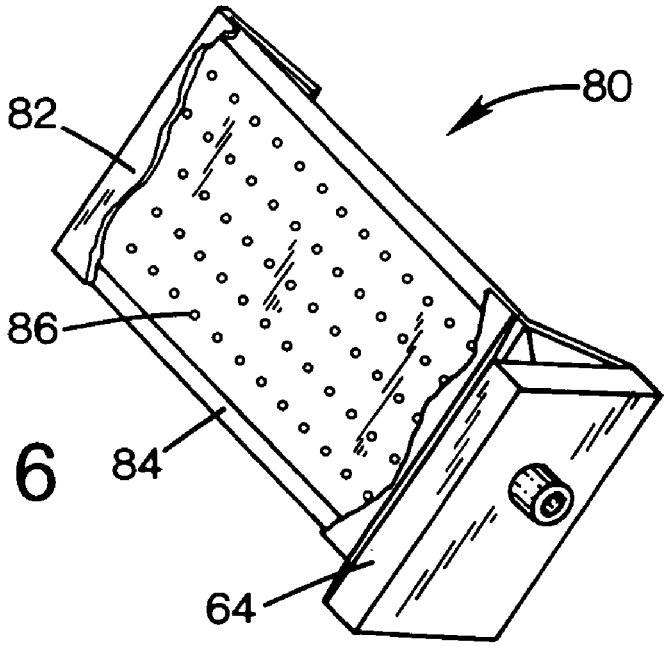
FIG. 6 is an isometric view of a further embodiment of a bag suitable for use in a fluid supply or print cartridge, employing an adhesive dot pattern to create negative pressure.

FIG. 6 shows yet another alternate embodiment of a bag structure 80 which can be used as the negative pressure generating structure in the fluid supply of FIG. 3. The bag structure includes a fitment 64 as with structure 60 (FIG. 4A). In this case, the sacrificial bond structure holding the sides 82, 84 together is an adhesive dot pattern comprising adhesive dots 86 between the adjacent surfaces of the bag sides 82, 84. In use, as fluid is drawn from the fluid chamber of the fluid supply, the bag sides will be drawn apart by the negative pressure, and the adhesive dots will incrementally break apart, allowing air to enter the bag and relieve the increasing negative pressure. In other respects, the bag structure 80 is similar to bag structure 60. In an exemplary embodiment, the adhesive dot pattern comprises a pattern of dots 86 having a typical diameter of 1.0 mm to 4.0 mm and center-to-center dot spacing ranging from 2 mm to 9 mm. Exemplary adhesives suitable for the purpose include silicone, cross-linked silicon and acrylic based adhesives with good creep resistant properties.

For an exemplary backpressure range of interest on the order of 1–12 inches of water, or from 248.8 Pa to 2986.1 Pa, stakes applied to the exterior of the bag only create a light bond between the two inside surfaces of the bag, so that when they release, bag film integrity is maintained. This is beneficial because the cycle time for this stake process is minimized, requirements for the material set are reduced since additional components do not require attachment and the risk associated with ink compatibility is also reduced since the exterior of the film is not affected. Likewise, in other embodiments described above, adhesive is only applied to the inside of the bag, so similar advantages are again realized.

The exemplary fluid supplies described above are relatively inexpensive free-ink designs that are more efficient than foam based, or partial-foam-partial free-fluid designs. Free fluid systems also offer greater flexibility because, the physical size can be reduced due to their greater flexibility. At the time of manufacture, the supply is filled with ink so very little air is left inside the supply and the initial backpressure is created by priming the supply through the FI. This minimizes any air expansion during shipping when the supply could be subjected to altitude/temperature excursions and eliminates supplying the printheads with large volumes of air upon start-up. Since the majority of the bag volume is restrained by the stake dot pattern (tuned for a higher operating pressure range), only a minor volume of fluid must be extracted to create an initial backpressure in the 1–2.5 inches of water range, or 248.8 Pa to 622.1 Pa, dependent upon supply height. Since additional air does not accumulate in the supply throughout life, altitude/temperature robustness is maintained.

Exemplary embodiments provide simple, adjustable, high efficiency free-ink systems. Backpressure generation is accomplished using a simple, low cost bag assembly with one, or two components. Since the bag operates in a backpressure range suitable for most ink jet products and the form factor is easily changed, it offers extensibility to new platforms. Volumetrical efficiency of exemplary embodiments for ink supplies decreases the number of supply interventions by the customer.

Figure 7:
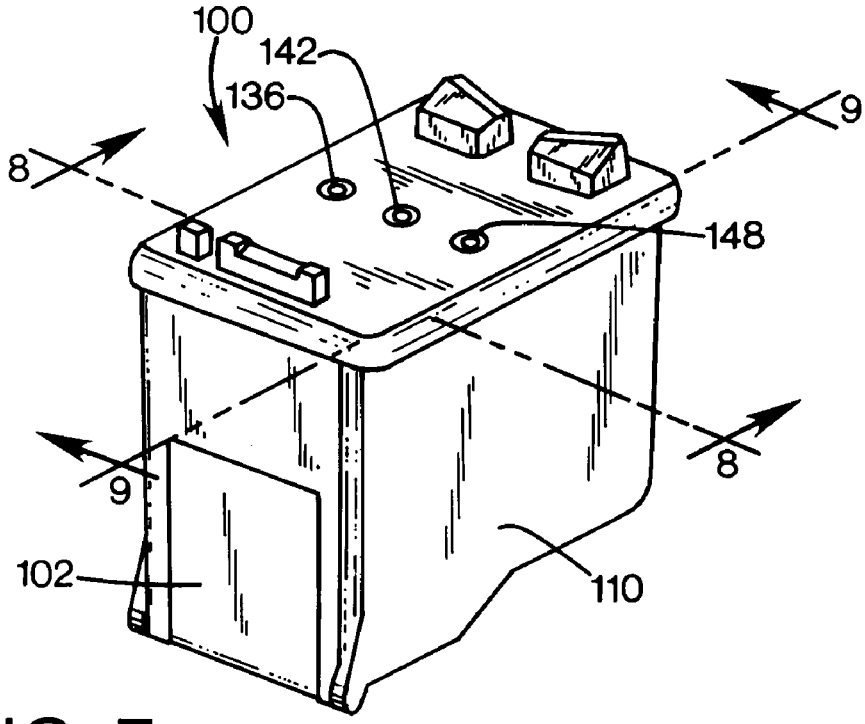
FIG. 7 is a simplified isometric view of an exemplary three-chamber inkjet printhead using an expandable bag to create negative pressure in each chamber.

Backpressure-generating structures described above also apply to a replaceable inkjet cartridge instead of a fluid supply. In the case of an ink-jet cartridge, a printhead structure, e.g., a THA (TAB head assembly), substitutes for the FI. An exemplary embodiment of a tri-chamber inkjet cartridge 100 with a backpressure generating bag structure for each chamber is illustrated in FIGS. 7–13. FIG. 7 shows the cartridge 100 in isometric view. The cartridge includes a cartridge body 110, to which is assembled a lid structure 120. A THA 102 is attached to surfaces of the body, and carries the printhead nozzle arrays which are fired to eject ink drops during operation. The body 110 includes interior walls 122A, 122B (FIG. 8) which divide the interior of the body into three ink chambers 124A, 124B, 124C. A feed channel with filter screen (not shown) for each chamber leads from the chamber to a printhead plenum (not shown) for delivery to a nozzle array.

Figure 8:
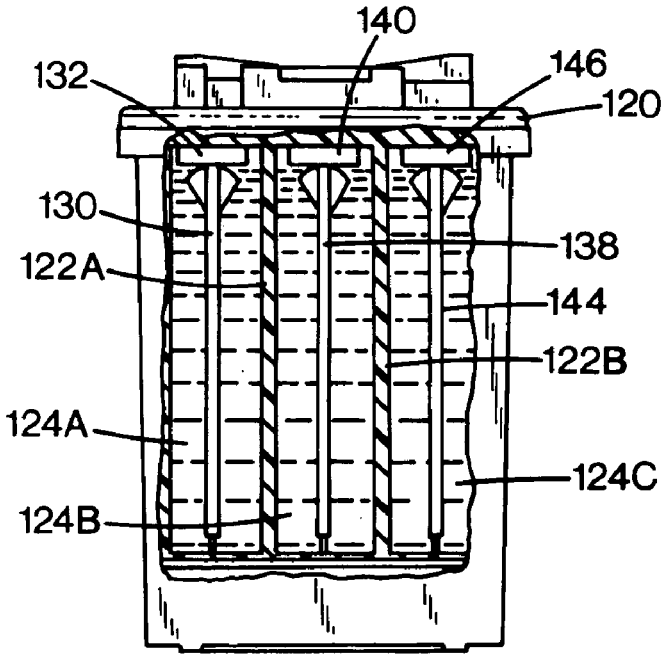
FIG. 8 is a cross-sectional view taken along line 8—8 of FIG. 7, showing the bags in an initial state after ink fill, prior to initiating printing.

As shown in FIG. 8, backpressure-generating means are provided in each ink chamber of the print cartridge. These means include, for chamber 124A, a bag structure 130 attached to a fitment 132, in turn attached to the lid 120, and vented to the atmosphere through vent 136 formed in the lid and through the fitment 132. Similarly for chamber 124B, a bag structure 138 is attached to a fitment 140, in turn attached to the lid 120, and vented to the atmosphere through vent 142 formed in the lid and through the fitment 140. For chamber 124C, a bag structure 144 is attached to a fitment 146, in turn attached to the lid 120, and vented to the atmosphere through vent 148 formed in the lid and through the fitment 146.

Figure 9:
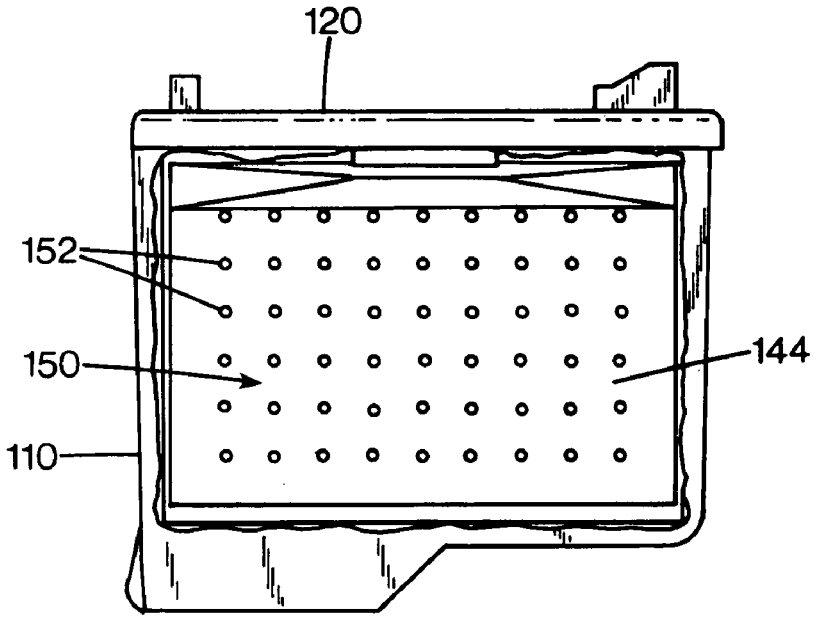
FIG. 9 is a cross-sectional view taken along line 9—9 of FIG. 7, in the initial state and showing an exemplary stake pattern.

Each of the bags includes a sacrificial bond pattern, e.g. a stake pattern, between opposed sides which opposes bag opening to create negative pressure, yet incrementally releases to maintain the negative pressure in a desired range until the free ink within the chamber is substantially exhausted. FIG. 9 is a cross-section taken through line 9—9 of FIG. 7, and shows an exemplary stake dot pattern 150 comprising stake dots 152 formed in bag structure 144.

Figure 10:
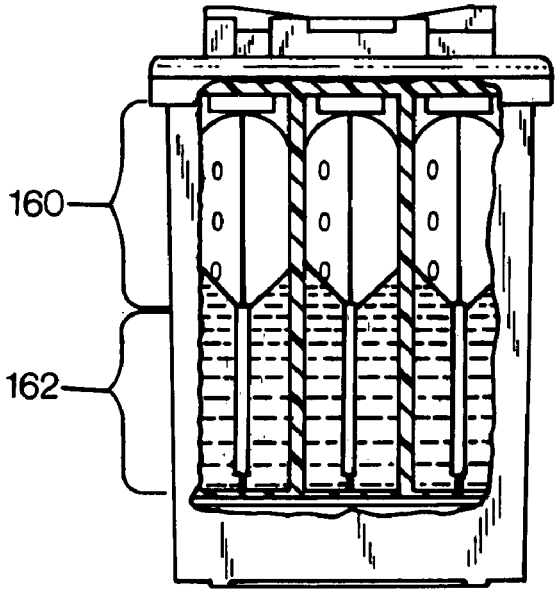
FIG. 10 is a cross-sectional view similar to FIG. 8, but showing the bags in partially expanded states after some printing, with the respective ink reservoirs half-empty.
Figure 11:
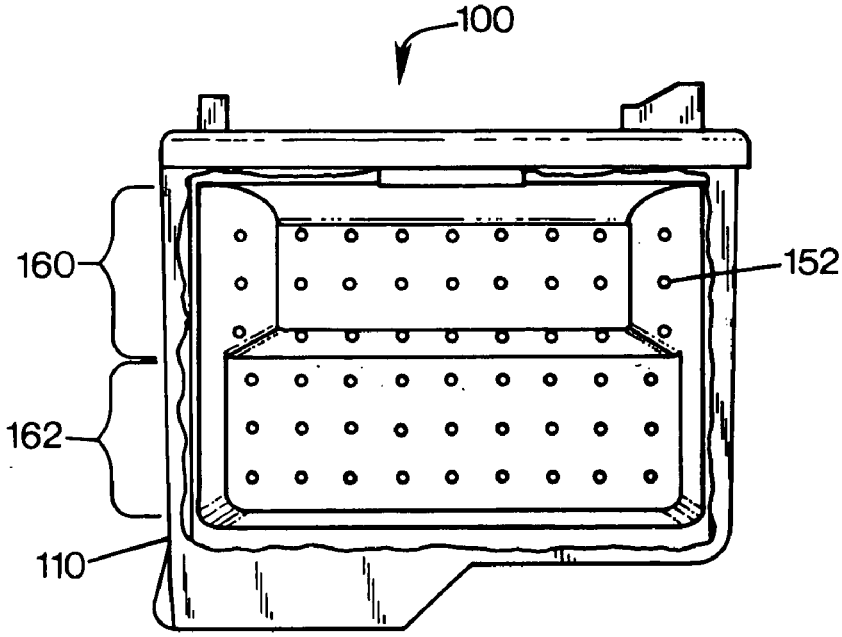
FIG. 11 is a cross-sectional view similar to FIG. 9, but showing an exemplary bag in side view in a partially expanded state.
Figure 12:
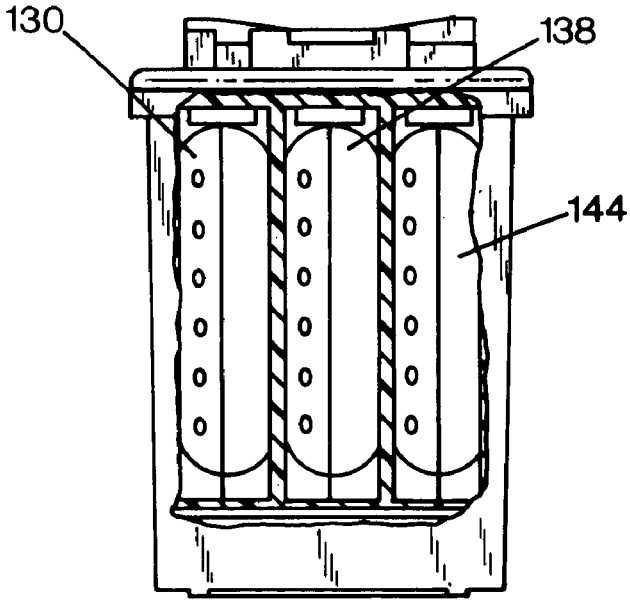
FIG. 12 is a cross-sectional view similar to FIG. 8, but showing the bags in fully expanded states at end of life for the print cartridge.
Figure 13:
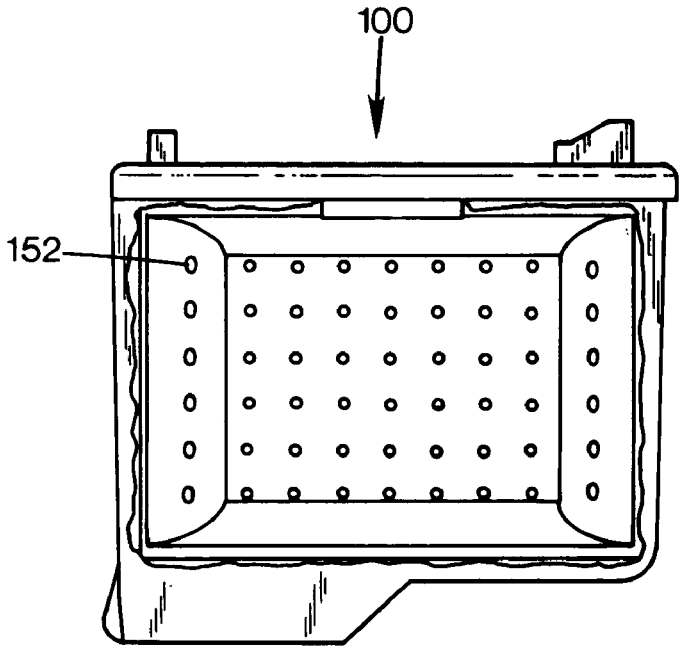
FIG. 13 is a cross-sectional view similar to FIG. 9, but showing the bag in a fully expanded state.

FIGS. 8 and 9 illustrate the full fluid state wherein each chamber 124A, 124B, 124C is filled with fluid, and the bags are in their fully collapsed state with the stake dots intact. FIGS. 10–11 are similar to FIGS. 8–9, but show the state in which the ink in each chamber has been partially depleted. Here the stake dots in an expanded portion 160 of the bags adjacent the vent have released, allowing the bag sides to open apart and for air to enter through the vent into the bag into the opened portion. The stake dots in portion 162 of the bags have not released. FIGS. 12–13 show the state in which the bags are fully opened. Here, all the stake dots have released, and the bag has opened to its capacity with air drawn through the vent. The ink is substantially exhausted from the chambers. Of course, it will be appreciated that the chamber depletion rates will typically vary, and the chambers may not all be depleted at the same time, for embodiments in which each compartment holds a different color.

Figure 14:
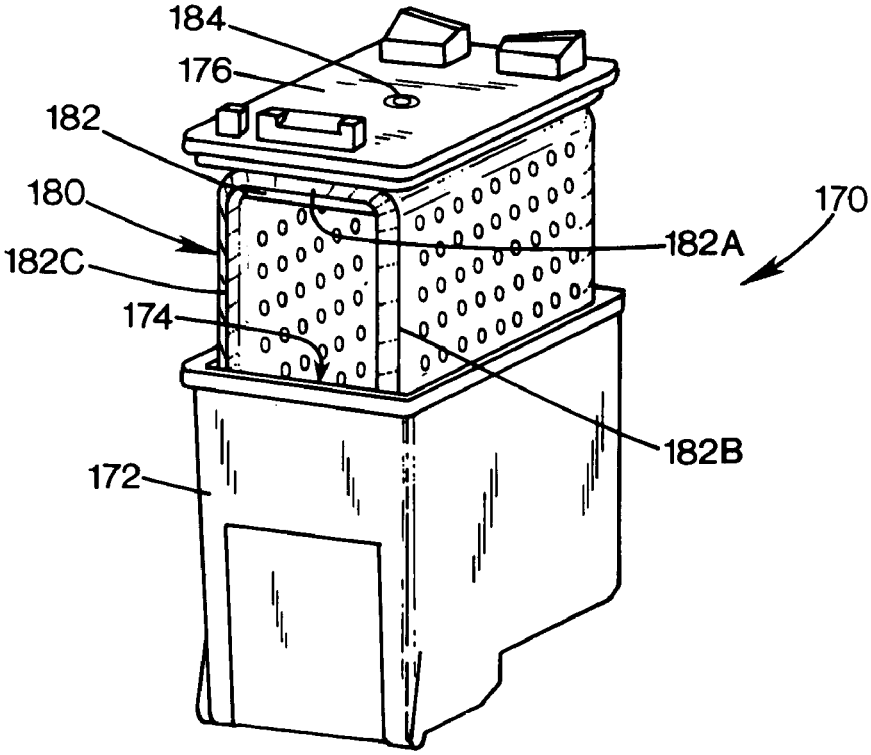
FIG. 14 is a partially-exploded isometric view of a print cartridge with a single reservoir, employing a pleated bag to create negative pressure.
Figure 14A:
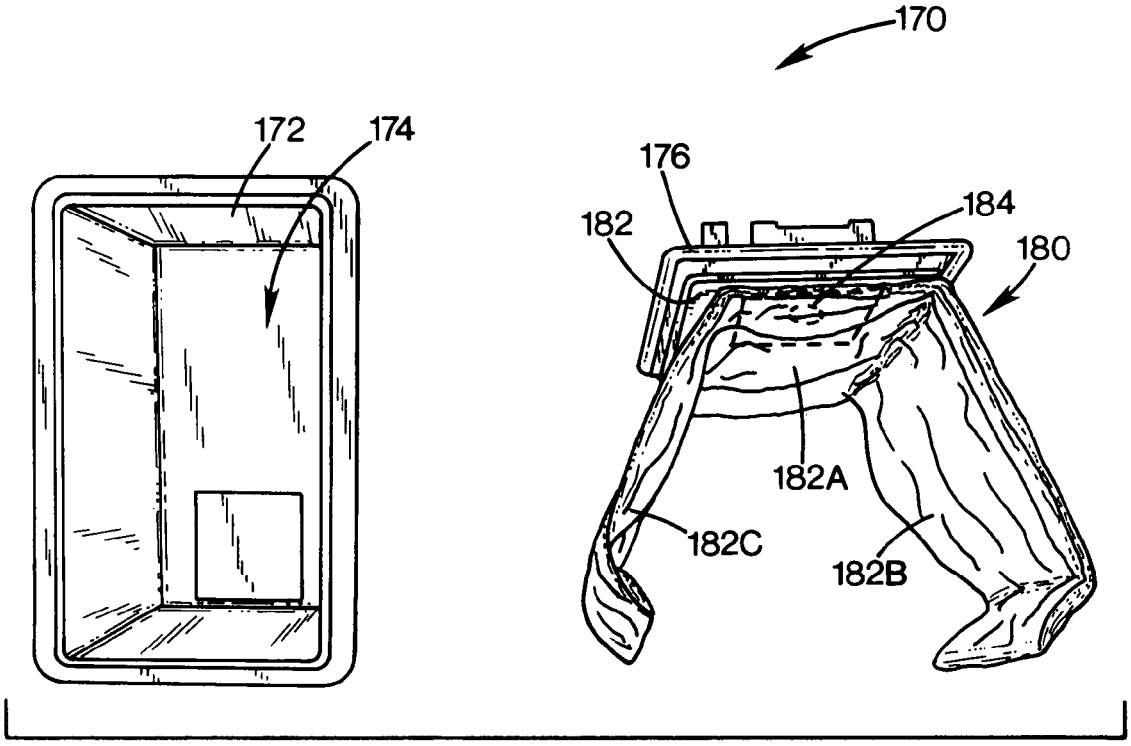
FIG. 14A is an isometric view of the cartridge body and lid and bag assembly of the print cartridge of FIG. 14, with the body separated from the lid and bag assembly.

Another embodiment is shown in FIGS. 14–14A. Here, the print cartridge 170 has a single interior fluid chamber, instead of multiple chambers as in the embodiment of FIGS. 8–13. To provide a form factor and volume that closely match the internal volume of the single fluid chamber, a segmented, "saddle-like" bag 180 is employed. The cartridge 170 includes a body 172 which defines the chamber 174. A lid 176 has assembled to it the back-pressure generating bag structure 180. This bag has a generally U shape as folded into the body 172, with a bridge portion 182A extending along the lid, and two leg portions 182B, 182C connected by the bridge portion. The bag is gusseted to create the shape, with interior passageways connecting the bridge portion to each leg portion. The bag sides forming the bridge portion have a set of sacrificial stake dots, or other sacrificial bonding means, formed therein. Similarly, the bag sides forming each leg portion each have a set of sacrificial stake dots or other sacrificial bonding means formed therein. In use in a printer, with the bag in a collapsed state and the print cartridge filled with ink, the sacrificial bond patterns are all intact. As ink is ejected by the printhead on the print cartridge, ink is drawn from the ink chamber 174, increasing the backpressure in the chamber. Eventually, the backpressure increases to a point at which sacrificial bonds are broken. This typically will first occur in the bridge portion of the bag. Air enters the bridge portion through the vent 184 formed through the lid and fitment 182, relieving the increase in backpressure. As ink continues to be drawn from the chamber as a result of printing or printhead maintenance operations, backpressure will increase again, and the sacrificial bond structures will incrementally be broken, allowing additional air to enter the bag 180 and the leg portions while maintaining a negative pressure within a desired range, until all the bonds have been broken, and the bag has assumed its fully inflated state within the body 172.

A backpressure generating structure as described above can be employed in a variety of fluid supplies and printhead arrangements. FIGS. 15–16 illustrate a fluid supply 200 suitable for use in a "snapper" type of fluid supply/printhead system, i.e. a system which utilizes a fluid supply and printhead which reside in a carriage, i.e. "on-axis," with the fluid supply separable from the printhead. The fluid supply 200 is shown in exploded isometric view in FIG. 15, and comprises a fluid vessel body 210 which defines a fluid chamber 212. A lid 220 is attached to the body 210 to enclose the fluid chamber. A fluid interconnect (FI) 204 provides a means to pass fluid through the body from the fluid chamber. The FI in this exemplary embodiment comprises a septum which has a slit through which a hollow needle can be passed to allow fluid communication. A backpressure generating structure 230 is attached to the lid in this exemplary embodiment, and includes a bag structure 232 having an open end attached to a fitment 234. The fitment is attached to the lid, and includes a vent 236 which passes through the lid 220 to allow communication between the external environment and the interior of the bag. A sacrificial stake pattern 238 is formed in the bag as described above, and includes a plurality of stake dots 240, which weakly bond interior side surfaces of the bag together.

FIG. 16 shows a printhead structure 250 which includes mounting stalls 260A–260D for a plurality of replaceable fluid supplies 200A–200D. The fluid supplies may, for example, hold cyan, magenta, yellow and black inks, respectively. Fluid interconnects 262A–262D respectively provide fluid communication to the fluid supplies to feed ink to printhead arrays (not shown) on the printhead structure 250. Each of the fluid supplies 200A–200D includes a backpressure generating structure as shown in FIG. 15.

Figure 17:
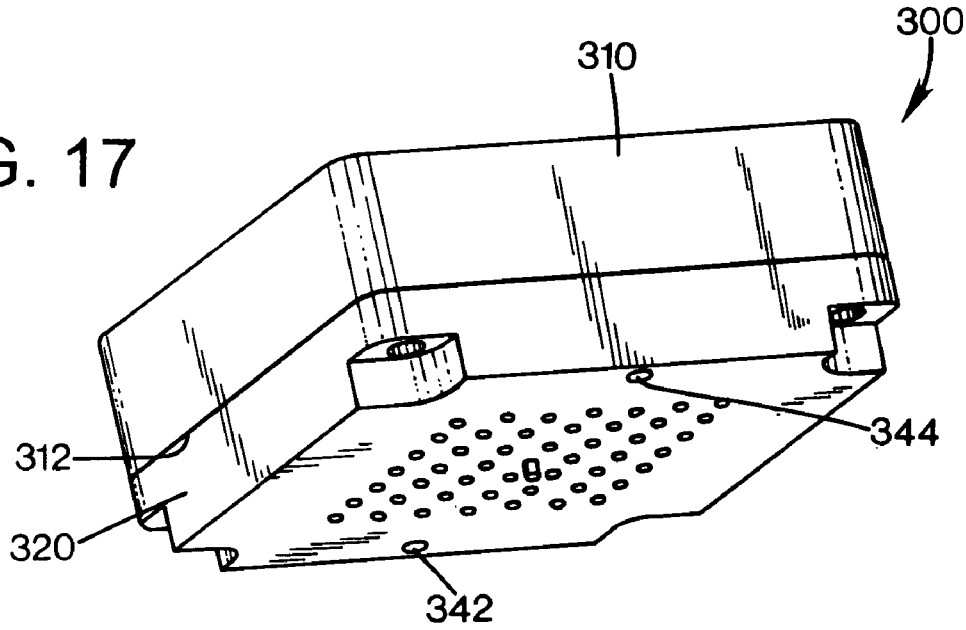
FIG. 17 is a simplified isometric view of an exemplary embodiment of a modular stake dot heat assembly for fabricating negative pressure bags.
Figure 18:
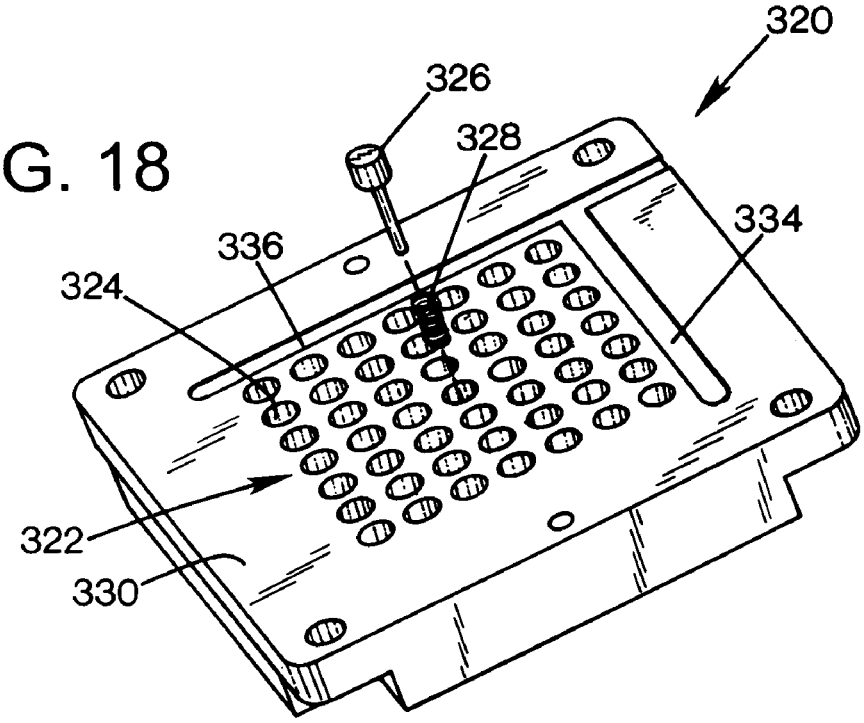
FIG. 18 is a reverse isometric view of the assembly of FIG. 17, showing an exemplary stake dot tip.

Referring now to FIGS. 17–18, an exemplary embodiment of a modular stake head 300 is illustrated, which can be employed to create a sacrificial stake-dot pattern for a backpressure generating bag assembly, as illustrated above in FIGS. 1–2, for example, for a free-ink fluid supply or print cartridge. Depending on the product form factor, different bag geometries may be utilized to maximize the delivered volume. With each new bag geometry, the stake-dot position relative to the fitment and bag folds, the stake-dot spacing and the bond diameter will all affect the pressure required to break the sacrificial bonds. By using a modular stake head with removable stake-dot tip elements, pressure characterization for different bag geometries, stake-dot bond diameters and individual dot positions can all be accomplished quickly and cost effectively, compared to making multiple dedicated geometry stake heads.

Exemplary embodiments of a modular stake head enable the use of replaceable stake-dot tip elements while maintaining planarity across them when the head is fully populated. A problem associated with using a modular stake head is how to eliminate the tolerance stack-up between the retaining feature of each tip element, and the corresponding surfaces in the modular stake head. This variation causes two problems which alone, or combined, affect accurate pressure characterization of the stake-dots created on the bag. First, each tip element is preferably constantly biased against the heated surface to create uniform heat transfer and a consistent temperature. Secondly, inconsistent tip element height produces inconsistent heat transfer to the bag. By utilizing compression springs in an exemplary embodiment to bias each tip element against the heated stake head surface 312, the tolerance stack-up is eliminated, and the planarity across all stake-dot tip elements is directly related to the overall length tolerance specified for each of them.

The modular stake head assembly 300 includes a generic stake head heating module 310, which houses standard electrical resistance heater elements and thermocouple control circuits (not shown in FIG. 17). The assembly 310 is connected to a source of electrical power, for powering the heater elements and control circuits. The heating module 310 includes a planar mounting face surface 312. The heating module 310 thus provides a surface 312 and a means for heating the surface.

The assembly 300 also includes a stake-dot module head 320, which includes a grid 322 of through hole openings or receptacles 324 formed therethrough for receiving stake-dot tip elements and corresponding bias springs. For clarity, only a single stake-dot tip element 326 with its spring 328 is shown in exploded fashion in FIG. 18. Some of the receptacles of the grid may be vacant for a particular application, depending on the shape and size of a particular bag, although all openings may receive a tip element in many applications. This embodiment of the module head 320 includes a planar mating surface 330 and an oppositely facing tip surface 332.

After loading the desired stake-dot tip elements to produce a given stake-dot pattern, and their corresponding springs, into the appropriate through hole openings 324, the modular stake-dot head 320 is attached to the heating module 310, e.g. using threaded fasteners. The respective mating surfaces 312, 330 of the generic head module 310 and the module head 320 are ground flat when manufactured to maintain planarity and provide effective heat transfer between the heated surface 312 of the heating module and the module 320. In an exemplary embodiment, the face 330 of the module head 320 is equipped with two recessed areas 334, 336 where each column and row of stake-dot positions are marked with a letter and number, respectively. As stake-dot tip elements are loaded, this facilitates recording which positions are being used for an experiment, or which ones are needed for different types/sizes of bags.

Figure 19:
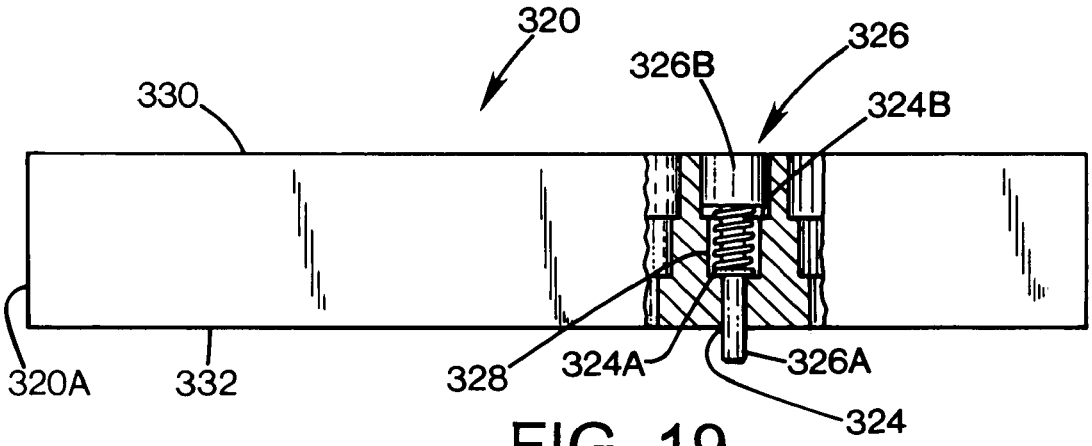
FIG. 19 is a cut-away side view of the assembly of FIG. 17.

FIG. 19 is a partially-broken-away side view of an exemplary embodiment of the module head 320. As shown therein, each stake-dot tip element 326 with its spring 328 is fitted into a through hole or receptacle 324 formed through the head housing 320A. The receptacle diameter is stepped to form two shoulders 324A, 324B. Shoulder 324A provides a stop surface for the spring. The shoulder 324B is defined by a counterbore to provide clearance for the spring 328 and the head 326B of the stake-dot tip element within the housing 320A. The tip end 326A of each tip element protrudes from surface 332 of the housing 320A, and comes into contact with the material to be staked during a staking procedure. The tip end 326A is sized to provide a tip surface diameter to define a stake dot of a desired dimension. The head portion 326B in this exemplary embodiment has a diameter larger than the tip end, and is biased against the heated surface 312 of the heating module 310 when the module head 320 is assembled to the module 310. (In FIG. 19, the spring 328 is shown in its compressed state, and the tip element 326 in position as though the module head 320 were assembled to the heating module 310.) The tip elements 326 have a length greater than the depth of the head housing 320A, so that, with the head portions 326B in contact with the heated surface 312, the tips 326A of the respective tip elements protrude from the surface 332, and serve as stand-off elements, spacing the surface 332 away from the material to be staked. Thus, only the tips 326A of the tip elements are brought into contact with the material to be staked during a heat staking operation, so that the heat staked areas are defined by the tip elements.

Figure 20:
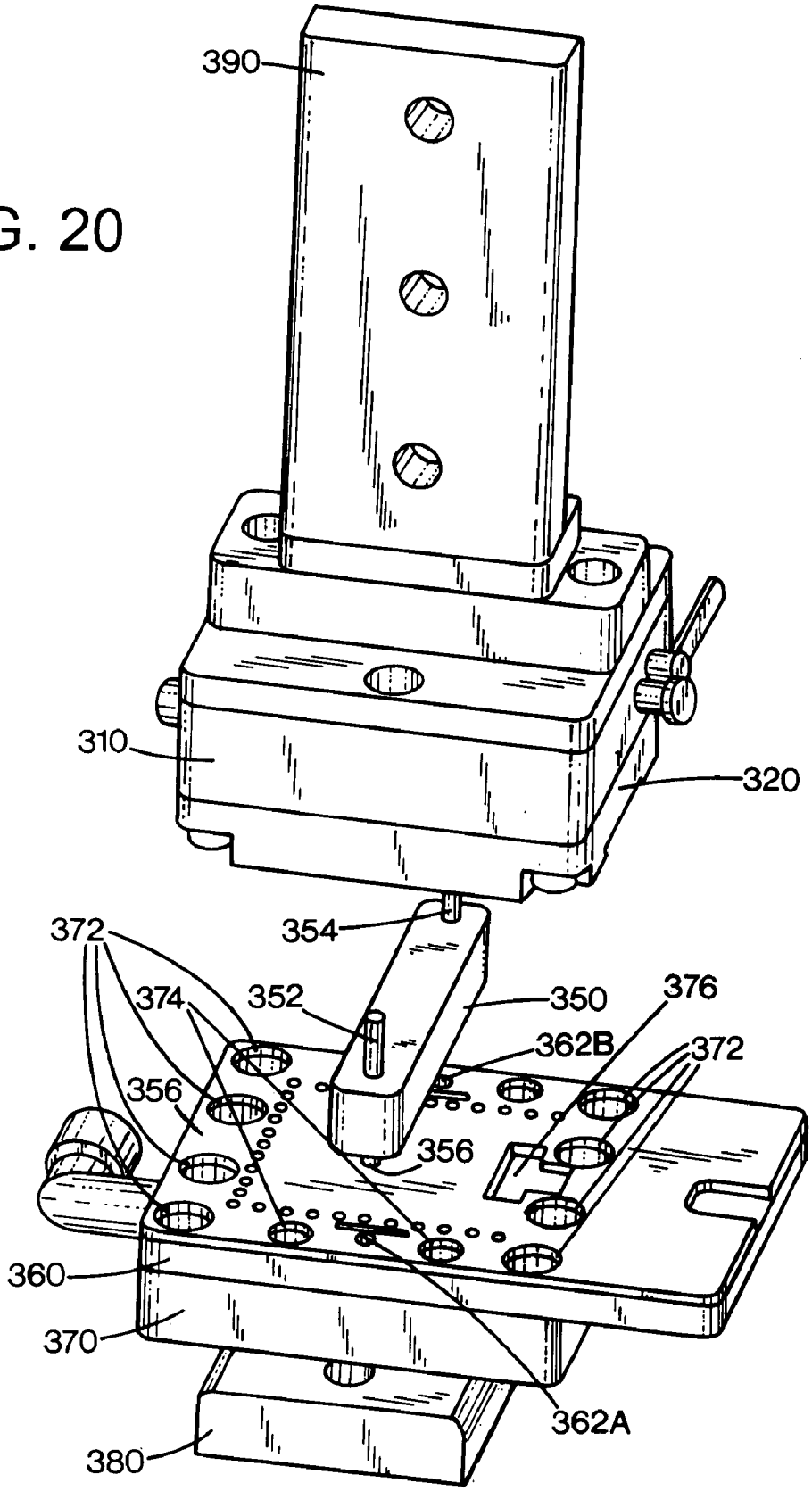
FIG. 20 is an isometric view of an exemplary staking system for fabricating sacrificial bond structures for a fluid supply bag.

In order to easily align the stake-dot pattern to the bag, the module head 320 is equipped with two alignment holes 342, 344. Referring now to FIG. 20, these holes 342, 344 mate to precision dowel pins 352, 354 extending from an alignment fixture 350. The alignment fixture has a lower set of dowel pins, including pin 356, which in turn mate to alignment holes 362A, 362B in a lower tooling plate 360 that fixtures the bag. The lower tooling plate is in turn fastened to a vacuum plate 370 by a set of fasteners 372. The vacuum plate is mounted on a horizontal slide assembly 380 which can move the lower tooling plate in a horizontal plane or axis. The lower tooling plate and vacuum plate are mounted through four clearance holes 374 with fasteners (not shown) so the fasteners can be loosened, the fixture 350 inserted into both plates and the fasteners re-tightened. Thus, to accurately position the stake head 320 to the lower tooling plate, the head 320 is lowered by hand and the tooling plate assembly is floated into position so that the lower dowel pins 356 engage holes 362A, 362B in the tooling plate. The fasteners 374 are then secured, and the alignment fixture 350 is removed.

A bag/fitment assembly is placed on the lower tooling plate 360 and vacuum is applied through the vacuum plate 370, which secures the bag in place for subsequent operations. An opening 376 is formed in the tooling plate 360 to provide a relief recess for the bag fitment, so that the top portion of the bag will lie flat when vacuum is applied. The fitment may also be connected to a vacuum line to evacuate the bag, so that it will lie flat during the stake process. Evacuating the bag during the stake process may be omitted, e.g. when the bag is not pleated. Evacuating a pleated bag may be used to assist in holding the bag flat during the stake process. The horizontal slide brings the bag assembly forward in line with the head 320, at which time the vertical slide brings the stake head 320 down, bringing the tip elements into contact with the bag, to stake the bag at the desired force/pressure. After the staking operation, the vertical slide is retracted, followed by the horizontal slide to allow for removal of the finished bag and subsequent staking of a new one.

In an exemplary embodiment, the stake-dot tip element length is controlled to within a tolerance of ±0.001 inch (0.0254 mm) which translates into overall planarity when all tips are inserted equal to ±0.001 inch (0.0254 mm), which are standard machined tolerances that still provide sufficient precision without adding significant cost.

To ensure uniform heat transfer and expansion, the housings of the heating module 310 and module head 320, and the stake-dot tip elements are all fabricated from the same material. Exemplary materials with good heat transfer properties such as aluminum and copper are suitable for these structures.

Exemplary embodiments of the modular heat staking system allow cost-effective, rapid-prototyping and pressure characterization for different bag designs and stake-dot patterns. The modular approach enables the user to quickly characterize individual stake-dot positions, groups of stake-dots, or produce a complete pattern on multiple bag geometries. If a different stake-dot size is desired, new sets of tips are easily produced with different end diameters. Otherwise, dedicated one-piece stake-dot heads would have to be fabricated to test each different combination, adding significant development time and cost. The modular approach is also extensible to long-term manufacturing, since the replaceable stake-dot tip elements can easily be replaced as they wear out.

Although the foregoing has been a description and illustration of specific embodiments of the invention, various modifications and changes thereto can be made by persons skilled in the art without departing from the scope and spirit of the invention as defined by the following claims.

What is claimed is:

1. A fluid containment structure, comprising:

a containment vessel having an interior vessel space for fluid containment;

a fluid outlet communicating with the interior vessel space;

a flexible bag disposed within the containment vessel, said bag vented to an external atmosphere outside the containment vessel, said bag comprising opposed side surfaces;

a sacrificial bond structure formed between said side surfaces in an initial bag state, said bond structure for restraining the side surfaces together until a sufficient back-pressure within the interior space exerts sufficient force to break said sacrificial bond structure, allowing air from the external atmosphere to enter the bag and enlarge an interior bag space.

2. The structure of claim 1, wherein said bag is fabricated from a non-elastic material, and has a deployed form factor and volume which generally matches a corresponding form factor and said interior space of said containment vessel.

3. The structure of claim 1, further comprising a fitment providing a vent path between said interior bag space and the external atmosphere.

4. The structure of claim 3, wherein said fitment comprises a plastic structure having a through hole comprising said vent path, said plastic structure attached to a wall surface of said containment vessel.

5. The structure of claim 1, wherein said bag is in a substantially evacuated condition in said initial bag state, and said sides are flattened together.

6. The structure of claim 1, wherein said sacrificial bond structure incrementally breaks in response to the negative pressure to regulate the negative pressure within the interior vessel space until a maximum bag space is reached.

7. The structure of claim 1, wherein said sacrificial bond structure comprises a pattern of spaced sacrificial adhesive dots or patches adhered to adjacent portions of said opposed side surfaces.

8. The structure of claim 1, wherein said sacrificial bond structure comprises a sacrificial layer of adhesive adhered to said opposed side surfaces.

9. The structure of claim 1, wherein said sacrificial bond structure comprises a pattern of sacrificial spaced heat staked patches or dots joining said opposed side surfaces.

10. The structure of claim 1, wherein said sacrificial bond structure comprises a sacrificial heat staked area joining said opposed side surfaces.

11. The structure of claim 1, wherein said containment vessel comprises an open vessel body, and a cover attached to said vessel body.

12. The structure of claim 1, further comprising a fitment attached to said bag and having a through hole formed therein to communicate with the interior bag space.

13. The structure of claim 12, wherein said vessel body has a vent opening formed therein, and said fitment is attached to said vessel body with said through hole in communication with the vent opening.

14. The structure of claim 12, wherein said cover has a vent opening formed therein, and said fitment is attached to said cover with said through hole in communication with the vent opening.

15. The structure of claim 1, wherein said containment vessel is for containment of ink for an ink jet printing system, and further comprising a supply of ink disposed within said vessel space.

16. The structure of claim 15, wherein the flexible bag in the initial bag state has a small internal volume, the small internal volume substantially filled with a fluid having a density similar to said ink.

17. The structure of claim 1, further comprising a supply of fluid disposed within said vessel space.

18. A fluid containment structure, comprising:

a containment vessel having an interior vessel space for fluid containment and a fluid outlet;

means for regulating a negative fluid pressure within said vessel space, said means comprising a bag disposed within the containment vessel, said bag vented to an external atmosphere outside the containment vessel, said bag comprising opposed side surfaces, and sacrificial bond means formed between said side surfaces in an initial bag state, said bond means for restraining the side surfaces together until a sufficient back-pressure within the interior space exerts sufficient force to incrementally break said sacrificial bond means, allowing air from the external atmosphere to enter the bag and enlarge an interior bag space to regulate the negative pressure within the interior vessel space until a maximum bag space is reached.

19. The structure of claim 18, wherein said means for regulating comprises a pattern of spaced sacrificial adhesive dots or patches adhered to adjacent portions of said opposed side surfaces.

20. The structure of claim 18, wherein said means for regulating comprises a sacrificial layer of adhesive adhering said opposed side surfaces.

21. The structure of claim 18, wherein said means for regulating comprises a pattern of spaced sacrificial heat staked patches or dots joining said opposed side surfaces.

22. The structure of claim 18, wherein said means for regulating comprises a sacrificial heat staked area joining said side surfaces.

23. The structure of claim 18, wherein said containment vessel is for containment of ink for an ink jet printing system, and further comprising a supply of ink disposed within said vessel space.

24. The structure of claim 18, further comprising a supply of fluid disposed within said vessel space.

25. A fluid containment system, comprising:

a containment vessel defining a fluid chamber;

a fluid passageway communicating with the fluid chamber;

a back-pressure generating structure comprising a thin membrane bag disposed within the containment vessel, said bag vented to atmosphere while being closed to the chamber, said bag constructed from a single or multi-layer non-elastic film with a form factor and volume that closely match an internal volume of the supply, or cartridge, and a sacrificial bond structure bonding opposed sides of said bag together.

26. The system of claim 25, wherein the back-pressure generating structure further comprises:

a fitment with a through hole for attaching the bag to the containment vessel.

27. The system of claim 25, further comprising a supply of fluid disposed within said fluid chamber.

28. A fluid containment structure, comprising:

a containment vessel having an interior vessel space for fluid containment and a fluid outlet;

a thin membrane bag disposed within the containment vessel, said bag vented to an external atmosphere outside the containment vessel, said bag comprising side surfaces;

sacrificial bonds formed between said side surfaces in an initial bag state, said bonds for restraining the side surfaces together until a sufficient back-pressure within the interior space exerts sufficient force to break one or more of said sacrificial bonds, allowing air from the external atmosphere to enter the bag and enlarge an interior bag space to regulate the negative pressure within the interior vessel space until a maximum bag space is reached.

29. The structure of claim 28, wherein said bag is fabricated from a non-elastic material, and has a deployed form factor and volume which generally matches a corresponding form factor and said interior space of said containment vessel.

30. The structure of claim 28, further comprising a fitment providing a vent path between said interior bag space and the external atmosphere.

31. The structure of claim 30, wherein said fitment comprises a plastic structure having a through hole comprising said vent path, said plastic structure attached to a wall surface of said containment vessel.

32. The structure of claim 28, wherein said bag is in a substantially evacuated condition in said initial bag state, and said sides are flattened together.

33. A printhead structure which includes a plurality of mounting stalls and fluid interconnects for a plurality of replaceable fluid supplies, each of said replaceable fluid supplies comprising a fluid supply as in claim 3.

34. A fluid supply for an inkjet printing system, comprising:

a containment vessel having an interior vessel space for fluid containment;

a fluid interconnect communicating with the interior vessel space;

a flexible bag disposed within the containment vessel, said bag vented to an external atmosphere outside the containment vessel, said bag comprising opposed side surfaces;

a sacrificial bond structure formed between said side surfaces in an initial bag state, said bond structure for restraining the side surfaces together until a sufficient back-pressure within the interior space exerts sufficient force to break said sacrificial bond structure, allowing air from the external atmosphere to enter the bag and enlarge an interior bag space.

35. The fluid supply of claim 34, wherein said bag is in a substantially evacuated condition in said initial bag state, and said sides are flattened together.

36. The fluid supply of claim 34, wherein said sacrificial bond structure incrementally breaks in response to the negative pressure to regulate the negative pressure within the interior vessel space until a maximum bag space is reached.

37. The fluid supply of claim 34, wherein said sacrificial bond structure comprises a pattern of spaced sacrificial adhesive dots or patches adhered to adjacent portions of said opposed side surfaces.

38. The fluid supply of claim 34, wherein said sacrificial bond structure comprises a sacrificial layer of adhesive adhered to said opposed side surfaces.

39. The fluid supply of claim 34, wherein said sacrificial bond structure comprises a pattern of sacrificial spaced heat staked patches or dots joining said opposed side surfaces.

40. The fluid supply of claim 34, wherein said sacrificial bond structure comprises a sacrificial heat staked area joining said opposed side surfaces.

41. The fluid supply of claim 34, wherein said containment vessel comprises an open vessel body, and a cover attached to said vessel body.

42. The fluid supply of claim 34, further comprising a fitment attached to said bag and having a through hole formed therein to communicate with the interior bag space.

43. The fluid supply of claim 42, wherein said vessel body has a vent opening formed therein, and said fitment is attached to said vessel body with said through hole in communication with the vent opening.

44. The fluid supply of claim 42, wherein said cover has a vent opening formed therein, and said fitment is attached to said cover with said through hole in communication with the vent opening.

45. The fluid supply of claim 34, further comprising a supply of fluid disposed within the vessel body.

46. A print cartridge for an inkjet printing system, comprising:

a containment vessel having an interior vessel space for fluid containment;

a fluid ejecting printhead attached to the vessel, and in fluid communication with the interior vessel space;

a flexible bag disposed within the containment vessel, said bag vented to an external atmosphere outside the containment vessel, said bag comprising opposed side surfaces;

a sacrificial bond structure formed between said side surfaces in an initial bag state, said bond structure for restraining the side surfaces together until a sufficient back-pressure within the interior space exerts sufficient force to break said sacrificial bond structure, allowing air from the external atmosphere to enter the bag and enlarge an interior bag space.

47. The print cartridge of claim 46, wherein said bag is in a substantially evacuated condition in said initial bag state, and said sides are flattened together.

48. The print cartridge of claim 46, wherein said sacrificial bond structure incrementally breaks in response to the negative pressure to regulate the negative pressure within the interior vessel space until the bag is fully deployed within the interior vessel space.

49. The print cartridge of claim 46, wherein said sacrificial bond structure comprises a pattern of spaced sacrificial adhesive dots or patches adhered to adjacent portions of said opposed side surfaces.

50. The print cartridge of claim 46, wherein said sacrificial bond structure comprises a sacrificial layer of adhesive adhered to said opposed side surfaces.

51. The print cartridge of claim 46, wherein said sacrificial bond structure comprises a pattern of sacrificial spaced heat staked patches or dots joining said opposed side surfaces.

52. The print cartridge of claim 46, wherein said sacrificial bond structure comprises a sacrificial heat staked area joining said opposed side surfaces.

53. The print cartridge of claim 46, wherein said containment vessel comprises an open vessel body, and a cover attached to said vessel body.

54. The print cartridge of claim 46, further comprising a fitment attached to said bag and having a through hole formed therein to communicate with the interior bag space.

55. The print cartridge of claim 54, wherein said cover has a vent opening formed therein, and said fitment is attached to said cover with said through hole in communication with the vent opening.

56. A print cartridge for an inkjet printing system, comprising:

a containment vessel having a plurality of interior vessel spaces for fluid containment;

a fluid ejecting printhead attached to the vessel, and in fluid communication with the interior vessel spaces;

a flexible bag disposed within each of the vessel spaces, said bag vented to an external atmosphere outside the containment vessel, said bag comprising opposed side surfaces;

a sacrificial bond structure formed between said side surfaces of each bag in an initial bag state, said bond structure for restraining the side surfaces together until a sufficient back-pressure within the interior space exerts sufficient force to break said sacrificial bond structure, allowing air from the external atmosphere to enter the bag and enlarge an interior bag space.

57. A method for regulating negative pressure in a fluid containment structure, comprising:

providing a closed fluid containment vessel with a supply of fluid disposed in a fluid chamber, the vessel having a flexible bag disposed within the containment vessel, said bag vented to an external atmosphere outside the containment vessel, said bag comprising opposed side surfaces, and a sacrificial bond structure formed between said side surfaces in an initial collapsed bag state;

withdrawing fluid from the fluid chamber through a fluid outlet, thereby increasing negative pressure within said fluid chamber;

restraining the side surfaces together until a sufficient negative pressure within the interior space exerts sufficient force to incrementally break a portion of said sacrificial bond structure, drawing air from the external atmosphere into the bag and fractionally enlarge an interior bag space to regulate the negative pressure within the interior vessel space.

58. The method of claim 57, further comprising:

successively further withdrawing fluid from the fluid chamber through the fluid outlet, thereby again increasing said negative pressure; and incrementally breaking further portions of said sacrificial bond structure, until said bag is fully deployed within said fluid chamber.

59. The method of claim 58 wherein the sacrificial bond structure includes a pattern of stake dots adhering dot areas of the respective side surfaces together, and wherein said incrementally breaking further portions of said sacrificial bond structure comprises breaking respective ones of the stake dots.

* * * * *

UNITED STATES PATENT AND TRADEMARK OFFICE

CERTIFICATE OF CORRECTION

PATENT NO. : 6,981,763 B2
APPLICATION NO. : 10/732073
DATED : January 3, 2006
INVENTOR(S) : Anthony D. Studer et al.

It is certified that error appears in the above-identified patent and that said Letters Patent is hereby corrected as shown below:

In column 12, line 61, in Claim 33, delete “claim 3” and insert -- claim 32 --, therefor.

Signed and Sealed this

Ninth Day of June, 2009

John Doll

JOHN DOLL
*Acting Director of the United States Patent and Trademark Office*